US012789871B2

(12) United States Patent
Kessel

(10) Patent No.: US 12,789,871 B2
(45) Date of Patent: Nov. 10, 2026

(54) FREIGHT TRAIN DUAL POWER SOURCE CONTROL SYSTEM

(71) Applicant: VOLTIFY INC., Philadelphia, PA (US)

(72) Inventor: Alon Kessel, Ramat Gan (IL)

(73) Assignee: VOLTIFY INC., Philadelphia, PA (US)

( * ) Notice: Subject to any disclaimer, the term of this patent is extended or adjusted under 35 U.S.C. 154(b) by 54 days.

(21) Appl. No.: 18/942,849

(22) Filed: Nov. 11, 2024

(65) Prior Publication Data

US 2026/0131836 A1 May 14, 2026

(51) Int. Cl.
*B61L 99/00* (2006.01)
*B61C 7/04* (2006.01)
*B61C 17/06* (2006.01)

(52) U.S. Cl.
CPC ..... *B61L 99/002* (2024.01); *B61C 7/04* (2013.01); *B61C 17/06* (2013.01)

(58) Field of Classification Search
CPC ..... B61L 99/002; B61C 7/04; B61C 17/06; B61C 7/00
See application file for complete search history.

(56) References Cited

U.S. PATENT DOCUMENTS

2008/0288192 A1* 11/2008 Kumar ..... B60T 17/221 702/60

* cited by examiner

*Primary Examiner* — Jacob M Amick
(74) *Attorney, Agent, or Firm* — The Roy Gross Law Firm, LLC; Roy D. Gross

(57) ABSTRACT

A dual power source control system and method thereof for trains integrates a diesel and green energy power sources, comprises an alternating current traction diesel locomotive connectable to a green power source and an at least five control systems configured to optimize energy use, coordinate power distribution and interface with existing locomotive systems.

20 Claims, 5 Drawing Sheets

FREIGHT TRAIN DUAL POWER SOURCE CONTROL SYSTEM

FIELD OF THE INVENTION

The present invention is in the field of method or system of dual power source control for a locomotive.

BACKGROUND OF THE INVENTION

Nearly all freight locomotives in North America currently rely on diesel as their primary energy source for propulsion. However, there is an increasing need for alternative, eco-friendly energy sources. One promising approach is the development of dual-propulsion locomotives that can operate on both diesel and a green energy source, such as batteries.

A freight train typically comprises multiple locomotives, which provide the propulsion power, while the railcars carry the freight. The positioning of these locomotives can vary throughout the train, with units placed at the front, middle, or rear.

Most line-haul freight locomotives use AC traction motors, which are controlled by inverters utilizing IGBT technology. The traction motors and the tractive effort generated by each locomotive are regulated by adjusting the power and frequency supplied to each motor, as well as by controlling the power source that supplies power to all inverters collectively.

To implement a dual-energy propulsion system, a robust control system is required at both the train-wide and individual locomotive levels. However, designing a new dual-energy control system is both time-intensive and costly, creating an urgent need for a simpler, more cost-effective solution

SUMMARY OF THE INVENTION

It is hence an object of the invention to disclose a dual power source control system comprising: a dual power source; an at least five control systems; and an AC traction diesel locomotive connectable to a green power source; at least two of the at least five control systems are in communication with each other; wherein the at least five control system comprise:

a. train energy management system (EMS) configured to calculate power requirements for the locomotive and command power distribution to the locomotive based on operational commands;
b. source/power mode, configured to optimize energy use, maintain functionality under varying power conditions, and extend lifespan or operational capabilities of devices and systems;
c. power regulator, configured to synchronizes energy delivery between diesel and green sources;
d. central computer, configured to interact with the propulsion computer and diesel engine control system; and
e. propulsion computer configured to control power supplied at any given time of a given ride to each traction motor.

In some embodiments, the dual power source comprises a diesel power source configured to supply AC to the locomotive and a green power source configured to supply direct current to the locomotive.

In some embodiments, the train EMS is in communication with the source/power mode.

In some embodiments, the source/power mode is in communication with train EMS, power regulator, or central computer, including any combination thereof.

In some embodiments, the central computer is in communication with source/power mode, power regulator, or auxiliary power control system, including any combination thereof.

In some embodiments, the power regulator is in communication with diesel engine control, green power control, central computer, or propulsion computer, including any combination thereof.

In some embodiments, the train EMS comprises control logic configured to optimize power distribution adaptable to real-time condition changes.

In some embodiments, diesel engine is isolated when a green energy source is active.

In some embodiments, the diesel engine control comprises several subsystems, sensors or both.

In some embodiments, the propulsion computer comprises several subsystems, sensors or both.

It is hence another object of the invention to disclose a method for converting an alternating current (AC) traction diesel locomotive control system into a dual power source control system, the method comprising:

f. connecting a diesel locomotive to a green power source; and
g. connecting traction diesel locomotive control system with a dual power source control system; hereby obtaining a dual power source control system; wherein the dual power source control system comprises a dual power source; an at least five control systems; and an AC traction diesel locomotive connectable to a green power source; at least two of the at least five control systems are in communication with each other;

wherein the at least five control system comprise:

i. train energy management system (EMS) configured to calculate power requirements for the locomotive and command power distribution to the locomotive based on operational commands;
ii. source/power mode, configured to optimize energy use, maintain functionality under varying power conditions, and extend lifespan or operational capabilities of devices and systems;
iii. power regulator, configured to synchronizes energy delivery between diesel and green sources;
iv. central computer, configured to interact with the propulsion computer and diesel engine control system; and
v. propulsion computer configured to control power supplied at any given time of a given ride to each traction motor.

In some embodiments, the train EMS is in communication with the source/power mode.

In some embodiments, the source/power mode is in communication with train EMS, power regulator, or central computer, including any combination thereof.

In some embodiments, the central computer is in communication with source/power mode, power regulator, or auxiliary power control system, including any combination thereof.

In some embodiments, the power regulator is in communication with diesel engine control, green power control, central computer, or propulsion computer, including any combination thereof.

In some embodiments, the train EMS 800 comprises control logic configured to optimize power distribution adaptable to real-time condition changes.

In some embodiments, diesel engine is isolated when a green energy source is active.

In some embodiments, the diesel engine control comprises several subsystems, sensors or both.

In some embodiments, the propulsion computer comprises several subsystems, sensors or both.

It is hence another object of the invention to disclose a method for operating a locomotive comprising a dual energy source, the method comprising:

a. calculating power requirements for the locomotive using a train energy management system (EMS);
b. distributing power to the locomotive based on operational commands via the EMS;
c. selecting between a diesel energy source and a green energy source using a power regulator;
d. modifying communication between a locomotive propulsion computer and components based on the selected energy source via a loco power regulator;

wherein the EMS operates based on control logic configured to optimize power distribution adaptable to real-time condition changes.

BRIEF DESCRIPTION OF THE DRAWINGS

The presently disclosed subject matter may be more clearly understood upon reading in the following detailed description embodiments of non-limiting exemplary embodiments thereof, with reference to the drawings.

Dimensions of components and features shown in the figures are chosen for convenience or clarity of presentation and are not necessarily shown to scale. Wherever possible, the same reference numbers will be used throughout the drawings and the following description to refer to the same and like parts.

DETAILED DESCRIPTION OF THE PREFERRED EMBODIMENTS

Figure 1:
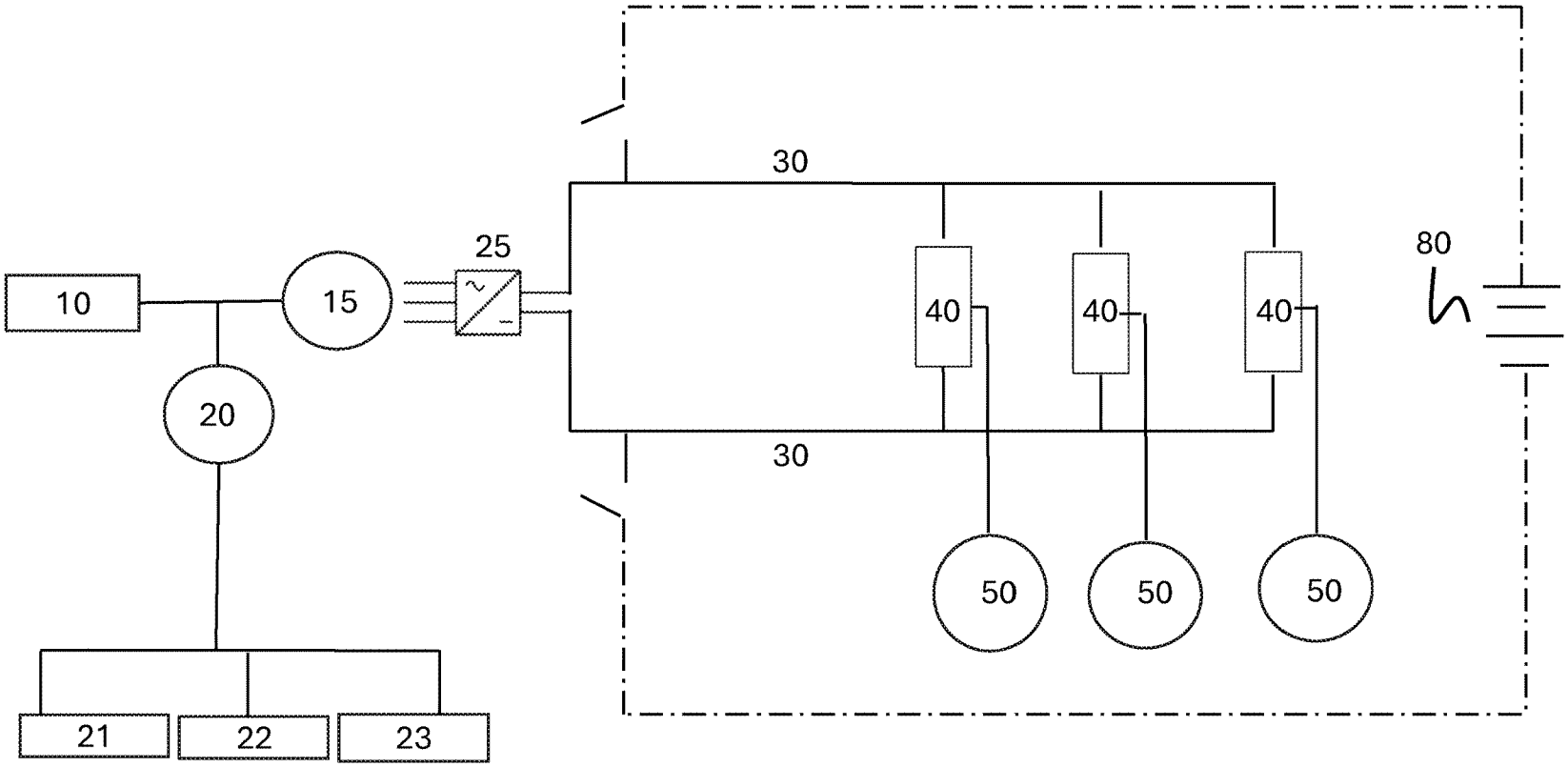
FIG. 1 is a scheme illustrating an AC traction locomotive connectable to a green power source, according to some embodiments of the present invention.

Unless otherwise defined, all technical and/or scientific terms used herein have the same meaning as commonly understood by one of ordinary skill in the art to which the invention pertains. Although methods and materials similar or equivalent to those described herein can be used in the practice or testing of embodiments of the invention, exemplary methods and/or materials are described below. In case of conflict, the patent specification, including definitions, will control. In addition, the materials, methods, and examples are illustrative only and are not intended to be limiting.

Further embodiments and the full scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

As used herein, the term "train", and "locomotive" are used interchangeably and refer in a non-limiting manner to one or several rail-connected vehicles and/or road, trail, cable, support or path-constrained vehicle, including e.g., manned or unmanned vehicle, automatic or non-autonomous vehicle, which may include railroad vehicles of the present invention, that are capable of being moved together along a guideway, such as rail tracks, a railway, a rail line, a commuter line, to transport freight and/or passengers and a freight line (any one of which may be a train that rolls, or a train that is magnetically levitated). While a train generally includes one or more locomotives to provide power for locomotion along rail tracks. The terms may be used here to mean a vehicle that moves along a rail, a vehicle that moves along a guideway as in a maglev train system, or a wheeled vehicle that must follow a catenary in order to receive electric power from the catenary for powering the vehicle.

In some embodiments, the rail system comprises at least one of the following elements: spur tracks, tracks, platforms, stations, signaling systems, switches and crossings, yards, bridges and tunnels, catenary system, or control centers, including any combination thereof. In some embodiments, the catenary system provides electrical power to the train. In some embodiments, the spur tracks refer to a rail road track that is branched off form a main.

As used herein, the term "AC traction diesel locomotive control system" is refers to a control system configured to convert diesel-generated power to AC power, regulating the traction motors for optimal performance, and providing precise control over the locomotive's speed and tractive effort. This technology is widely used in modern diesel-electric freight locomotives due to its reliability and efficiency. Typically, the AC traction diesel locomotive control system comprises a diesel engine and generator an AC traction motors, an inverter system, and a control system.

As used herein, the term "traction alternator" refers to an alternator used in locomotives to generate electrical power for traction motors, they play a crucial role in converting mechanical power from an engine into electrical power for electric traction systems. Traction motors are configured to drive the wheels and provide the source needed to move the locomotive forward. In addition, traction alternators are high-powered, rugged, and versatile devices designed to supply the substantial electrical power needed for heavy traction applications in locomotives.

As used herein the term "direct current (DC)" refers to unidirectional flow of electric charge, typically produced by sources such as batteries, solar cells, or DC generators. In direct current, electrons move consistently in a single direction through a conductor, as opposed to alternating current (AC), where the flow of electrons periodically reverses direction.

As used herein, the term "power source" refers to any system, material, or mechanism that provides energy to generate electricity, or fuel various processes. Power sources convert the energy obtained in different forms such as thermal, electrical, chemical, or mechanical, into usable energy for industries, homes, and devices. Two types of power source are commonly used today used, renewable energy sources and non-renewable energy source. Renewable energy source are energy sources that are replenished naturally and are typically more environmentally friendly because they do not emit greenhouse gases or pollutants during operation. Non-limiting examples of renewable energy sources include but are not limited to solar power, wind power, hydropower, geothermal energy, or biomass, including any combination thereof. Non-renewable energy sources do not replenish on a human timescale. Non-limiting examples for non-renewable energy sources include but are not limited to fossil fuels and nuclear energy. In some embodiments, the power source can be a dedicated power source, a nondedicated grid connection, or both.

As used herein, the term "inverter" converts direct current generated by solar power or batteries to a desired and useable AC electrical current. A "transformer" refers to a device that transforms electrical energy between two circuits through electromagnetic induction. Transformers are commonly used to change the voltage level of alternating current (AC) electrical power. A "rectifier" refers to a device that converts AC into direct current DC.

According to one aspect of the present invention, there is provided a dual power source control system comprising: a dual power source; an at least five control systems; and an AC traction diesel locomotive connectable to a green power source. In some embodiments, at least two of the at least five control systems are in communication with each other. In some embodiments, the at least five control system comprise: (i) train energy management system (EMS) 800; (ii) source/power mode 700; (iii) power regulator 600; (iv) central computer 300; and (v) propulsion computer 100.

In some embodiments, train EMS 800 is configured to calculate power requirements for the locomotive and command power distribution to the locomotive based on operational commands. In some embodiments, train EMS 800 is in communication with source/power mode 700. In some embodiments, train EMS 800 comprises control logic configured to optimize power distribution adaptable to real-time condition changes.

In some embodiments, source/power mode 700, configured to optimize energy use, maintain functionality under varying power conditions, and extend lifespan or operational capabilities of devices and system. In some embodiments, source/power mode 700 is in communication with train EMS 800, power regulator 600, or central computer 300, including any combination thereof In some embodiments, power regulator 600 is configured to synchronizes energy delivery between diesel and green sources. In some embodiments, power regulator 600 is in communication with diesel engine control 200, green power control 900, central computer 300, or propulsion computer 100, including any combination thereof.

In some embodiments, central computer 300 is in communication with source/power mode 700, power regulator 600, or auxiliary power control system 500, including any combination thereof.

In some embodiments, propulsion computer 100 configured to control power supplied at any given time of a given ride to each traction motor.

In some embodiments, dual power source comprises a diesel power source configured to supply AC to the locomotive and a green power source configured to supply direct current to the locomotive.

In some embodiments, the system of the present invention is configured to enable efficient energy management and allow adaptation to either diesel power source or green power sources. In some embodiments, the system of the present invention minimizes diesel emission and optimizes locomotive performance. In some embodiments, the system of the present invention enables seamless transitions between energy modes, promoting energy efficiency and adaptability.

Reference is now made to FIG. 1 an illustration of a dual power source system for a locomotive. The system comprises two energy sources, a diesel power source, a diesel engine 10, and a green power source, a battery 80. A diesel power source comprising a diesel engine 10, generates kinetic energy which is converted into electrical energy, AC, using alternators 20 and 15. The AC power generated by the main alternator (15) is rectified using rectifier 25 into DC which is used as a source for several traction inverters 40. Three Inverters 40 are configured to convert DC back into AC and supply AC to traction motors 50. Traction motors 50 are configure to generate torque which generate locomotive traction efforts. In addition, diesel engine 10 is connected to a companion alternator 20 configured to apply AC power to auxiliary components. Auxiliary components support secondary functions necessary for maintaining optimal locomotive operations, exemplary components are radiator 21, blower 22, and compressor 23.

In some embodiments, inverters 40 control motor speed and motor torque by adjusting the AC current frequency, and amount of power supplied to locomotive motor. In some embodiments, the traction effort is generated by the motor torque. A person skilled in the art would appreciate that the number of inverters 40 can change between different locomotives.

The green power source, battery 80, is connected directly to DC link 30 and can supply electrical energy, to inverters 40 which control the power supplied to motors 50.

In some embodiments, the dual energy source enhances operational flexibility by transiting between green power source and diesel power source, and ensures efficient torque and speed regulation in a locomotive. In some embodiments, the dual energy source enables dynamic energy management, which reduces the emission and improve energy efficiency in every locomotive operation.

A person skilled int the art would appreciate that in order to regulate total traction effort of the locomotive the power supplied to each motor is crucial.

As used herein, the term "traction power control system" and "propulsion computer" are used interchangeably, and refer to the system configured to control the power supplied at any given time to each traction motor, ensuring that the locomotive operates effectively whether it utilizes diesel or green energy.

As used herein, the term "central computer" refers to a system configured to interact with the propulsion computer and diesel engine control system according to the request of a crew member for less or more propulsion power. In addition, the central computer controls an auxiliary control system. Typically, a train crew member is present in a leading locomotive. In some embodiments, the leading locomotive is configured to control a train and power generated by the leading locomotive and an unmanned locomotive. The term "un manned locomotive" and "slave locomotive" are used interchangeably. In some embodiments, the total energy generated by the leading locomotive and slave locomotive has to meet requirement set by the crew. In some embodiments, the crew requirements for power, are transferred from the leading locomotive to the slave locomotive. In some embodiments, the leading locomotive and the slave locomotive communicate using a physical train communication line, radio communication, or both.

As used herein, the term "train control system" refers to a control system, used to manage and coordinate the power and braking effort in a multiplier locomotive. Train control system refer both to multiply unit (MU) control and to distributed power (DP) both define and regulated by the American railroad association (AAR). The train control system can operate using either physical communication cables or wireless communication. A common example of such a system is the "Locotrol" system, which is widely used for distributed power control.

As used herein, the term "diesel engine control" refers to the system and processes that manage the power output of a diesel engine to drive a train's traction motors, which are responsible for moving the train. This control system is critical in diesel-electric locomotives, where the diesel engine doesn't drive the wheels directly but rather powers an alternator, which then supplies electricity to inverters that control the power supplied to the traction motors.

In some embodiments, the central computer interacts with the propulsion computer, and diesel engine control system. In some embodiments, change in propulsion power is requested by train crew.

Non-limiting examples of auxiliary components include but are not limited to blowers, compressors, or alternators fields current supply, including any combination thereof.

In some embodiments, the propulsion power control system is configured to control the power supplied to traction motors. In some embodiments, the propulsion computer is in communication with central computer 300, the diesel engine control 200, or directly with a subsystem of diesel system (e.g., main alternator, etc.), including any combination thereof. In some embodiment, central computer 300, is in communication with diesel engine control 200, the propulsion computer 100, auxiliary power control 500, train control system 400, including any combination thereof.

Figure 2A:
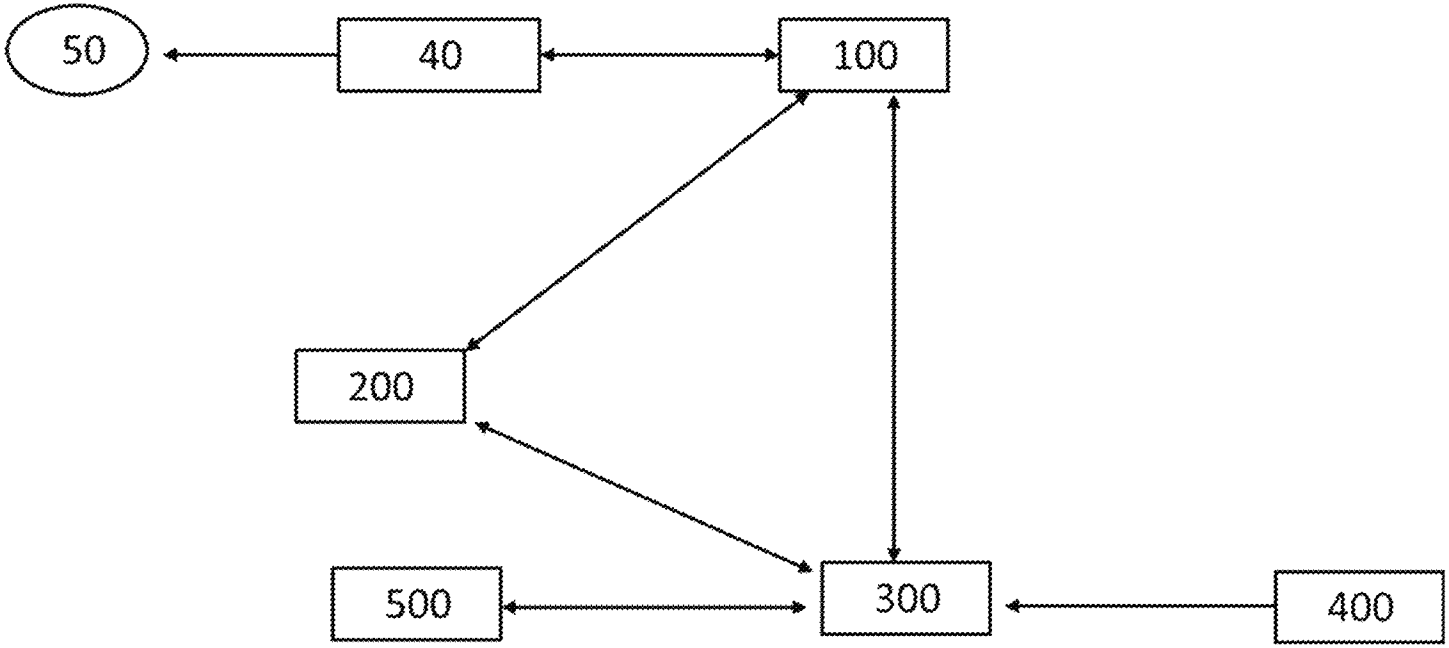
FIGS. 2A-2B is a block scheme illustrating the interaction between components in (2A) a typical train control system and (2B) a dual control system according to some embodiments, of the present invention.

Reference is now made to FIG. 2A, illustrating a schematic diagram of a typical control system architecture for a freight locomotive, emphasizing the interaction between various components. Traction motor 50 is connected to inverter 40 which interface with propulsion computer 100. Propulsion computer 100 is configure to interact with diesel engine control 200 and central computer 300. Central computer 300 is in communication with diesel engine control 200, propulsion computer 100, auxiliary power control 500, and train control system 400. In some embodiments, the central computer is in communication with either train control system 400, or a locomotive power throttle (not shown). In some embodiments, the locomotive power throttle is a physical device that enables train crew to change the power level.

In some embodiments, the central computer regulates power distribution based on operational requirements. In some embodiments, central computer 300 serves as a hub for integrating commands, inputs from diesel engine control 200, the propulsion computer, auxiliary power control 500, or train control system 400, including any combination thereof.

In some embodiments, the communication between propulsion computer 100, central computer 300 and diesel engine control 200 enables real-time adjustments of a locomotive power setting according to external controls and conditions. as used herein, the term "real-time adjustments" refer to changes or modifications made immediately with when a condition change, without delay. In some embodiments, real-time adjustments allow the system to respond instantly to new data or situations, ensuring optimal performance, safety, and efficiency of the locomotive.

Figure 2B:
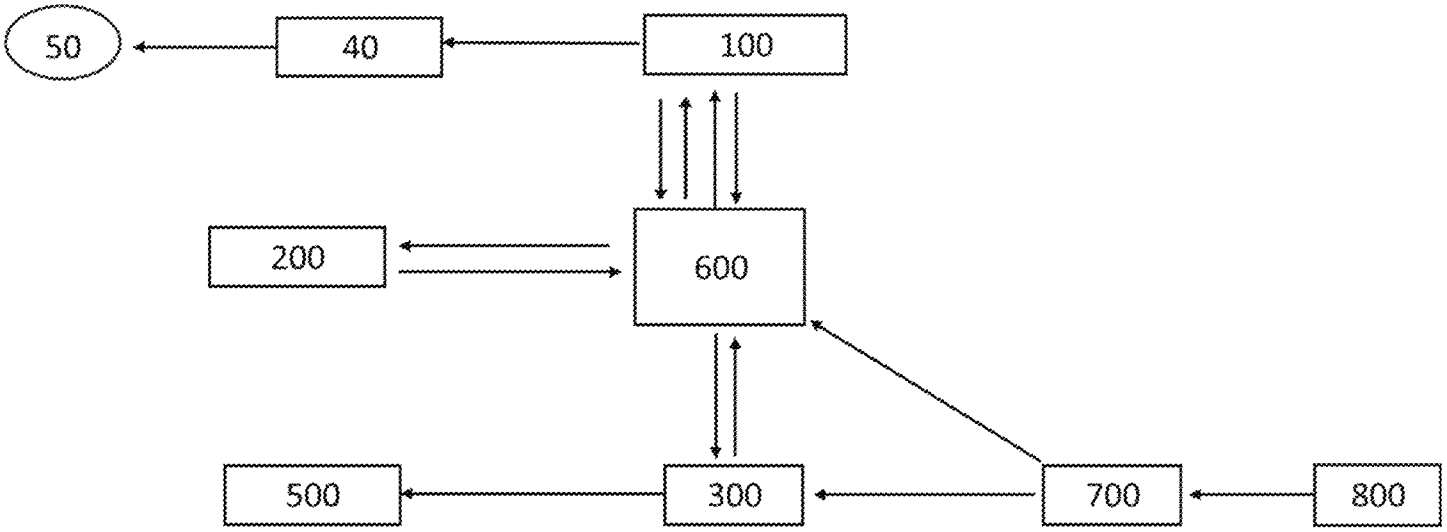

Reference is now made to FIG. 2B, illustrating a schematic diagram of a dual power control system architecture for a freight locomotive, emphasizing the interaction between various components, according to some embodiments of the present invention. In addition to the components (50, 40, 100, 200, 300 and 500) seen in FIG. 2A, an existing controlling system, the dual power control system of the present invention, further comprises three controlling systems, train energy management system (EMS), locomotive source mode regulator and locomotive power regulation. FIG. 2B demonstrates the communication in a dual power control system. Motor 50 connects to inverter 40 enabling the conversion of electrical power suitable for propulsion. Propulsion computer 100 interfaces with inverters 40 and coordinates with the power regulation 600 to modulate power delivery based on the energy source used.

Diesel engine control 200 is linked to inverters, enabling regulation of diesel power transfer. Additionally, diesel engine control 300 communicates with power regulator 600. In some embodiments, power regulator 600 is configured to synchronizes energy delivery between diesel and green sources. The auxiliary power control 500 is connected to central computer 300. In some embodiments, the central computer 300 is configured to perform system-wide coordination tasks. In some embodiments, central computer 300 serves as a main processing hub, consolidating input from the auxiliary power control 500 and regulating operational commands through the power regulator 600. Source/power mode 700, is connected to central computer 300 and to the power regulator 600 Central computer 300 is configured to determine current operational power source, informed by inputs from train EMS 800. In some embodiments, train EMS 800 is configured to calculates power requirements and disseminates operational parameters back to the source/power mode 700, ensuring that power source selection aligns with real-time energy needs. In some embodiments, communication between central computer 300 and train EMS 800, facilitates adaptive adjustments to optimize locomotive performance and emissions control. In some embodiments, power regulator 600*is* placed between traction power diesel engine control 200 and central computer 300. In some embodiments, a diesel power source control logic, refers to a train running on a diesel source. In some embodiments, the power regulator is transparent at a control logic comprises solely of a diesel power source control. As used herein, the term "transparent" refers to that the signal which pass through power regulator 600 pass with no change in output. In some embodiment, in a diesel power source control logic, power regulation signal input and output are the same. In some embodiments, a green source control logic, refers to a train running on a green power source. In some embodiments, in a green source control logic diesel engine 300 is in isolating mode. In some embodiments, in a green source control logic the power regulation signal input is alternated to an output the propulsion computer is configured to receive. In some embodiments, in a green source control logic the population computer operates as if power is transferred from diesel engine generates power at a desired level, although the diesel engine is in isolation mode, or shut down, and energy is transferred to the train using a green power source.

As used herein, the term "power regulator" refers to a computer configured to function when a signal between two communicating components is need to be changed.

As used herein, the term "energy management system (EMS)" refer to a system configured to calculate the total amount of power required for a locomotive to execute the crew command and distribute the total power needed between all of the locomotives in a consist.

In some embodiments, the train EMS receives at least two inputs. In some embodiments, one of the at least two input is or comprises an input commanding what speed and/or total power required for the train during that moment. In some embodiments, any command is transferred into the total power required to generate by all locomotives in a consist. In some embodiments, one of the at least two input is or comprises a control logic chosen by the train crew. In some embodiments, the at least to input is generated by a train crew, an autonomous control, or any combination thereof.

As used herein, the term "control logic" refers to any goals that can be achieved by controlling the power distribution and power source between locomotives in a consist. In some embodiments, control logic refers to a set of instructions or rules that determines how a system operates. In some embodiments, the control logic facilitates operational logic aimed to minimize emissions in specified areas, minimize cost efficient, or both. For example: a goal can be minimizing a train energy cost or particulate matter and nitrogen oxides (PM&NOx) emission near population area or use diesel alone. In this case, train EMS transfers to each individual locomotive a command to generate a speed or power as well as specifying which power source should be used. Slave locomotives can receive commands using train control system.

In some embodiments, a command from EMS is received in leading and slave locomotives, through a source mode regulator. In some embodiments, the source regulator sends signals to at least two controlling system, the central computer and locomotive power regulation. For example: (i) when the train EMS commands to set the power source as diesel, the source mode regulator would send a same command to the locomotive power regulator and the central computer, thereby diesel power is used and total power level is set to desired power level. (ii) when the train EMS commands to set the power source to green power source, the source regulator sends an isolating signal to the central computer, and sends a desired power level signal to the locomotive power regulator. As used herein, the term "isolate" or any grammatical derivative thereof refer to a diesel engine mode, in which the diesel engine operates and transfer energy solely to the auxiliary components, and power is not supplied to the DC link.

Figure 3A:
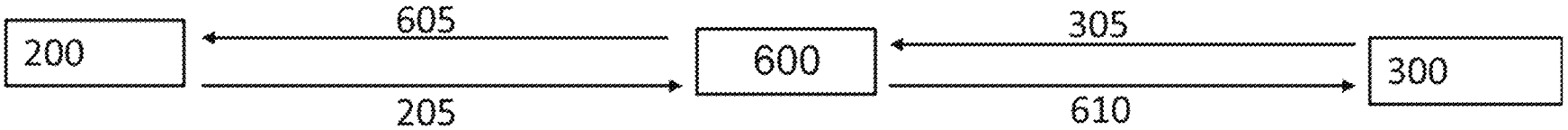
FIGS. 3A-3B are schemes representing communication between diesel engine control and central computer through power regulator (3A) at a diesel control logic, and (3B) at a green source control logic, according to some embodiments of the present invention.
Figure 3B:
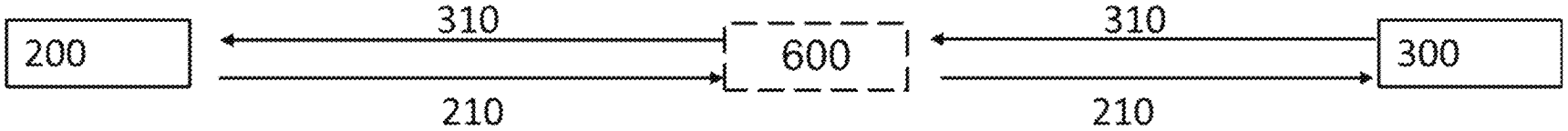

Reference is now made to FIG. 3A-3B, showing a schematic representation of communication between diesel engine control 200 and central computer 300 through power regulator 600. FIG. 3B, represents a signal pathway of a diesel power control logic. In diesel power control logic computer regulator 600 is transparent, input signal 310 from central computer 300 are the same output signal delivered from computer regulator to diesel engine control 200, and input signal 210 from diesel engine control are the same output signal delivered from computer regulator to central computer 300. In diesel power control logic computer regulator 600 maintains the signal passing through without any change. A diesel power control logic mimicking a direct communication pathway between diesel engine control 200 and central computer 300. As used herein, the terms "diesel power source", "diesel power" and "diesel source" are used interchangeably.

FIG. 3A, represents a signal pathway of a green power source control logic. In green power control logic computer regulator 600 is configured to alternate an input signal received from central computer 305 to an output signal to diesel engine control 605, and vice versa an input signal received diesel engine control 205 is alternated to an output signal to central computer 610. In some embodiments, computer regulator 600 is configured to intervene and/or modify its input signal according to the control logic. In some embodiments, computer regulator 600 enables various operational modes in data flow and flexibility. In some embodiments, computer regulator acts as a middle man. As used herein, the term "middleman" refers to an intermediary between two systems, subsystems, sensors, or any combination thereof that facilitates communication. A middleman plays a vital role in bridging gaps in distribution, logistics, and information flow, enabling smoother transactions As used herein, the terms "green power source", "green power" and "green source" are used interchangeably.

Figure 4:
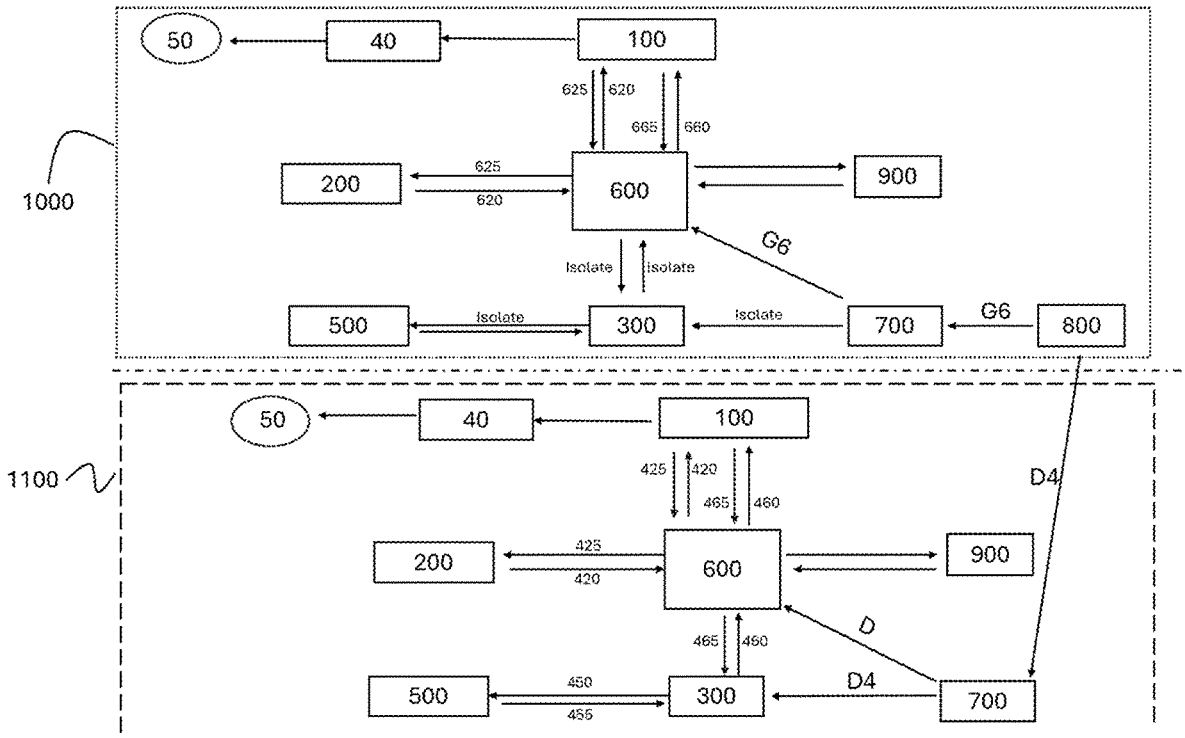
FIG. 4 is a scheme illustrating the control system components of both a leading and a slave locomotive, connected to a train energy management system (EMS), showing the flow of power and control via various modules such as traction inverters, propulsion computers, and source mode regulators.

Reference is now made to FIG. 4 shows an exemplary communication between the dual control system of the present invention according to some embodiments of the present invention. In the exemplary communication presented in FIG. 4 the train EMS requests leading locomotive to operate at a power level of 6 (notch 6) using a green power source and slave locomotive in a the consist to operate at a power level of 4 (notch 4) using a diesel source. For clarity, the operation communication and command given to the leading locomotive is presented in a doted box 1000, separated by a dash dote line from the command given to the slaves locomotive which is presented in a dashed box 1100. Train EMS sends a command (output signal) G6, to power the leading locomotive with a notch power of 6 using a green power source, and a command D4 to power the slave locomotive with a notch power of 4 using a diesel source. The total power (level 6+level 4) is a consequence of the crew demand wishing to accelerate or deaccelerate at the same moment, while the EMS decision to operate one locomotive at green source and one at diesel source is an implementation of a specific logic that was chosen by the crew for the ride.

When the source/power 300 regulator receives a command from EMS 800 in the leading locomotive to operate at diesel mode (D signal) it notifies power regulator 600 to operate at transparent mode, in which it lets all signals pass through without making any changes. The outcome is that communication between propulsion system 100, central computer 300, diesel control computer, and sub system is identical to that of a regular diesel control system, with no modification of the system to a dual control system. When the locomotive runs on diesel, the dual energy control system, of the present invention has no impact on the locomotive. The slave locomotive operates at notch 4 in identical way as it did with a regular control system.

As described above, the EMS in the leading locomotive commands the leading locomotive to operate at power level 6 (notch 6) using green energy source. Source/power mode 700 receive the command (G6) from EMS 800 and sends a different signal to central computer 300 and to power regulator 600. The central computer receives a signal to operate at isolate mode. In an isolate mode the diesel engine supplies power solely to the auxiliary system, via a companion alternator, but zero power for population. The central computer executes the command and operate the auxiliary subsystem at isolate mode. On the other hand, the power regulator 600 receives a signal from source/power mode 700 to operate at level 6 green mode (G6). While the power regulator 600 receive signal G6 it begins communicating with propulsion computer 100 and diesel engine control 200, imitating the signals that these computers are used to receive (625 and 660) and send (625, 620 and 665) when operating on diesel at power level 6 (notch 6). Propulsion computer 100 as well as diesel engine control 200 cannot differentiate between a diesel mode power level 6 and a level 6 green mode. Signals 660 and 665 are the same signals that would have passed between the propulsion computer and the central computer in a power level 6 diesel mode. 625 and 620 are the same signals that would have pass between the propulsion computer and diesel engine control in identical power level 6 in diesel on the other hand the central computer is communicating with the power regulator as it is in isolate mode and receive signals from the power regulator 600 imitating isolate mode.

Power regulator 600 is further in communication communicates with green power source control 900 (also used herein as "green source EMS"). Green power source control 900 coordinates amount of green power supplied to DC link (30) according to signals received from propulsion system 100. In some embodiments, the signal represent demand for specific power at specific voltage.

In some embodiments, diesel engine control 200 represent several subsystems and/or sensors. The communication between propulsion system and every subsystem and/or every sensor follow the same principles describes herein. In some embodiments, propulsion computer 100 central computer 300, or both communicate with additional control system, the communication follows the same principles described herein. In some embodiments, the communication between propulsion system and every subsystem and/or every sensor comprises a man in the middle component.

In some embodiment, the dual energy control system further comprises a new monitoring interface designed to provide real-time data feedback to locomotive crew and to enable them to choose the control logic. In some embodiment, the dual energy control system of the present invention uses existing interfaces to supply the locomotive crew with a relevant data (for example the state of charge of the energy storage system)

As used herein the terms "crew", "train crew", locomotive crew" are used interchangeably.

In some embodiment, the dual energy control system is configured such that transition between diesel and green energy sources in every locomotive is triggered by the leading locomotive EMS that operates according to predefine control logic, a set of predefined parameters stored in the central control logic. Non-limiting examples of predefined parameters include but are not limited to geographical location, environmental regulations in specific regions, or current energy prices, including any combination thereof. In some embodiments, the predefined parameters enable the locomotive to optimize operational efficiency while adhering to local laws and minimizing costs.

Non-limiting examples of an EMS control logic include but are not limited to minimize PM&NOx emission near urban communities minimize noise nearby communities or to minimize the journey energy cost, including any combination thereof. For examples, In the case that the green energy source in the train is lower than the desired power source for a train to fulfill its journey the EMS will operate based on the control logic minimize PM&NOx emission near urban communities. In this way the limited green energy source would be used only when the train is nearby communities, thus reducing the amount of PM&NOx emission near urban communities while having enough power source to fulfill its journey.

In some embodiment, the Power Regulator further comprises diagnostic and monitoring capabilities that continuously assess the integrity of the energy sources. In some embodiments, the diagnostic and monitoring capabilities enable predictive maintenance alerts, notifying the crew or maintenance teams of potential issues with diesel engine or green energy storage systems, thereby reducing downtime and enhancing reliability of locomotive operations.

According to another aspect of the present invention there is provided a method for converting an AC traction diesel locomotive control system into a dual power source control system, the method comprising: (i) connecting a diesel locomotive to a green power source; and (ii) connecting traction diesel locomotive control system with a dual power source control system; thereby obtaining a dual power source control system. In some embodiments, the dual power source control system is or comprises the dual power source system of the present invention. In some embodiments, a dual power source control system comprises a dual power source ; an at least five control systems; and an AC traction diesel locomotive connectable to a green power source. In some embodiments, at least two of the at least five control systems are in communication with each other. In some embodiments, the at least five control system comprise: (i) train energy management system (EMS) 800; (ii) source/power mode 700; (iii) power regulator 600; (iv) central computer 300; and (v) propulsion computer 100.

In some embodiments, train EMS 800 is configured to calculate power requirements for the locomotive and command power distribution to the locomotive based on operational commands. In some embodiments, train EMS 800 is in communication with source/power mode 700. In some embodiments, train EMS 800 comprises control logic configured to optimize power distribution adaptable to real-time condition changes.

In some embodiments, source/power mode 700, configured to optimize energy use, maintain functionality under varying power conditions, and extend lifespan or operational capabilities of devices and system. In some embodiments, source/power mode 700 is in communication with train EMS 800, power regulator 600, or central computer 300, including any combination thereof In some embodiments, power regulator 600 is configured to synchronizes energy delivery between diesel and green sources. In some embodiments, power regulator 600 is in communication with diesel engine control 200, green power control 900, central computer 300, or propulsion computer 100, including any combination thereof.

In some embodiments, central computer 300 is in communication with source/power mode 700, power regulator 600, or auxiliary power control system 500, including any combination thereof.

In some embodiments, propulsion computer 100 configured to control power supplied at any given time of a given ride to each traction motor.

In some embodiments, dual power source comprises a diesel power source configured to supply AC to the locomotive and a green power source configured to supply direct current to the locomotive.

According to another aspect of the present invention there is provided a method for operating a locomotive comprising a dual energy source, the method comprising: calculating power requirements for the locomotive using a train EMS; distributing power to the locomotive based on operational commands via the EMS; selecting between a diesel energy source and a green energy source using a power regulator; modifying communication between a locomotive propulsion computer and components based on the selected energy source via a power regulator.

In some embodiments, the train EMS operates based on control logic. In some embodiments, the control logic configured to optimize power distribution adaptable to real-time condition changes.

It is appreciated that certain features of the invention, which are, for clarity, described in the context of separate embodiments, may also be provided in combination in a single embodiment. Conversely, various features of the invention, which are, for brevity, described in the context of a single embodiment, may also be provided separately or in any suitable sub-combination. All combinations of the embodiments pertaining to the invention are specifically embraced by the present invention and are disclosed herein just as if each and every combination was individually and explicitly disclosed. In addition, all sub-combinations of the various embodiments and elements thereof are also specifically embraced by the present invention and are disclosed herein just as if each and every such sub-combination was individually and explicitly disclosed herein.

Additional objects, advantages, and novel features of the present invention will become apparent to one ordinarily skilled in the art upon examination.

The above illustrates and describes basic principles, main features and advantages of the present invention. Those skilled in the art should appreciate that the above embodiments do not limit the present invention in any form. Technical solutions obtained by equivalent substitution or equivalent variations all fall within the scope of the present invention.

What I claimed is:

1. A dual power source control system comprising
a dual power source;
an at least five control systems; and
an AC traction diesel locomotive connectable to a green power source;
at least two of said at least five control systems are in communication with each other;
wherein said at least five control system comprise:
train energy management system (EMS) 800 configured to calculate power requirements for said locomotive and command power distribution to said locomotive based on operational commands;
source mode regulating module 700, configured to optimize energy use, maintain functionality under varying power conditions, and extend lifespan or operational capabilities of devices and systems;
power regulator 600, configured to synchronize energy delivery between diesel and green sources;
central computer 300, configured to interact with the propulsion computer and diesel engine control system; and
propulsion computer 100 configured to control power supplied at any given time of a given ride to each traction motor.

2. The system of claim 1, wherein said dual power source comprises a diesel power source configured to supply AC to said locomotive and a green power source configured to supply direct current to said locomotive.

3. The system of claim 1, wherein said train EMS 800 is in communication with said source mode regulating module 700.

4. The system of claim 1, wherein said source mode regulating module 700 is in communication with train EMS 800, power regulator 600, or central computer 300, including any combination thereof.

5. The system of claim 1, wherein said central computer 300 is in communication with source mode regulating module 700, power regulator 600, or auxiliary power control system 500, including any combination thereof.

6. The system of claim 1, wherein said power regulator 600 is in communication with diesel engine control 200, green power control 900, central computer 300, or propulsion computer 100, including any combination thereof.

7. The system of claim 1, wherein said train EMS 800 comprises control logic configured to optimize power distribution adaptable to real-time condition changes.

8. The system of claim 1, wherein diesel engine is isolated when a green energy source is active.

9. The system of claim 1, wherein diesel engine control 200 comprises several subsystems, sensors or both.

10. The system of claim 1, wherein propulsion computer 100 comprises several subsystems, sensors or both.

11. A method for converting an alternating current (AC) traction diesel locomotive control system into a dual power source control system, said method comprising:
connecting a diesel locomotive to a green power source; and
connecting traction diesel locomotive control system with a dual power source control system; hereby obtaining a dual power source control system;
wherein said dual power source control system comprises
a dual power source;
an at least five control systems; and
an AC traction diesel locomotive connectable to a green power source;
at least two of said at least five control systems are in communication with each other;
wherein said at least five control system comprise:
train energy management system (EMS) 800 configured to calculate power requirements for said locomotive and command power distribution to said locomotive based on operational commands;
source mode regulating module 700, configured to optimize energy use, maintain functionality under varying power conditions, and extend lifespan or operational capabilities of devices and systems;
power regulator 600, configured to synchronizes energy delivery between diesel and green sources;
central computer 300, configured to interact with the propulsion computer and diesel engine control system; and
propulsion computer 100 configured to control power supplied at any given time of a given ride to each traction motor.

12. The method of claim 11, wherein said train EMS 800 is in communication with said source mode regulating module 700.

13. The method of claim 11, wherein said source mode regulating module 700 is in communication with train EMS 800, power regulator 600, or central computer 300, including any combination thereof.

14. The method of claim 11, wherein said central computer 300 is in communication with source mode regulating module 700, power regulator 600, or auxiliary power control system 500, including any combination thereof.

15. The method of claim 11, wherein said power regulator 600 is in communication with diesel engine control 200, green power control 900, central computer 300, or propulsion computer 100, including any combination thereof.

16. The method of claim 11, wherein said train EMS 800 comprises control logic configured to optimize power distribution adaptable to real-time condition changes.

17. The method of claim 11, wherein diesel engine is isolated when a green energy source is active.

18. The method of claim 11, wherein diesel engine control 200 comprises several subsystems, sensors or both.

19. The method of claim 11, wherein propulsion computer 100 comprises several subsystems, sensors or both.

20. A method for operating a locomotive comprising a dual energy source, said method comprising:

calculating power requirements for said locomotive using a train energy management system (EMS);

distributing power to the locomotive based on operational commands via said EMS;

selecting between a diesel energy source and a green energy source using a power regulator;

modifying communication between a locomotive propulsion computer and components based on the selected energy source via a loco power regulator;

wherein said EMS operates based on control logic configured to optimize power distribution adaptable to real-time condition changes.

* * * * *